US006737959B2

(12) United States Patent
Ho

(10) Patent No.: US 6,737,959 B2
(45) Date of Patent: May 18, 2004

(54) BAG WITH SOUND GENERATING MODULE

(76) Inventor: Chin-Lien Ho, No. 36, Lo-Yang Rd., Hsi-Tun Dist., Taichung City (TW)

( * ) Notice: Subject to any disclaimer, the term of this patent is extended or adjusted under 35 U.S.C. 154(b) by 312 days.

(21) Appl. No.: 09/878,349

(22) Filed: Jun. 12, 2001

(65) Prior Publication Data

US 2002/0185202 A1 Dec. 12, 2002

(51) Int. Cl.[7] ..... G08B 3/00

(52) U.S. Cl. ..... 340/384.1; 340/568.5; 340/568.6; 340/568.7; 340/568.8; 340/692; 383/18; 383/19; 383/28; 383/29

(58) Field of Search ..... 340/384.1, 568.7, 340/568.6, 568.5, 568.8, 572.3, 692; 206/760, 762; 383/18, 28, 19, 29, 30, 31, 20

(56) References Cited

U.S. PATENT DOCUMENTS 3,976,113 A * 8/1976 Kim ..... 383/20
5,062,717 A * 11/1991 Shockey ..... 383/20
6,133,831 A * 10/2000 Kyles ..... 340/568.4
6,137,410 A * 10/2000 Sepulveda ..... 340/568.7
6,283,299 B1 * 9/2001 Lee ..... 206/760
6,345,912 B1 * 2/2002 Ho ..... 383/20
6,414,906 B1 * 7/2002 Gaspari ..... 340/384.7
6,595,687 B2 * 7/2003 Godshaw et al. ..... 206/315.11
2002/0181719 A1 12/2002 Ho ..... 381/87

* cited by examiner

*Primary Examiner*—Jeffery Hofsass
*Assistant Examiner*—Daniel Previl
(74) *Attorney, Agent, or Firm*—Baker Botts L.L.P.

(57) ABSTRACT

A bag includes an upright bag body with a rectangular mouth portion confined by opposite longer walls and opposite shorter walls. At least one of the longer walls is formed with first strap holes therethrough. A carrying strap has opposite sections extending respectively through the first strap holes and formed with a respective retaining end for connecting the carrying strap to the bag body. A backing plate is disposed to lie against one of the longer walls, and is formed with second strap holes that permit extension of the carrying strap therethrough. A sound generating module has a frame unit mounted on the backing plate, and a data storage unit and an audio playback unit mounted on the frame unit. The audio playback unit is coupled to the data storage unit and is operable so as to audibly reproduce audio information stored in the data storage unit.

9 Claims, 9 Drawing Sheets

BAG WITH SOUND GENERATING MODULE

BACKGROUND OF THE INVENTION

1. Field of the Invention

The invention relates to a bag, more particularly to a bag with a sound generating module.

2. Description of the Related Art

Conventional gift bags are generally formed as an upright rectangular bag body made of paper or plastic. The bag body has two opposite longer walls which are provided with a respective set of strap holes near a top opening of the bag body for extension of a string member or the like to facilitate carrying. Such a conventional gift bag provides better support over conventional soft plastic bags, and defines a generally rectangular receiving space for neat placement of articles therein. Besides, the bag body of the conventional gift bag is often printed with various patterns to enhance the appearance thereof. It would be more desirable if the conventional gift bag is provided with additional functions so as to be able to adapt to different occasions.

SUMMARY OF THE INVENTION

Therefore, the main object of the present invention is to provide a bag with a sound generating module.

Accordingly, a bag of the present invention includes an upright bag body, a carrying strap, a backing plate, and a sound generating module. The bag body has a rectangular mouth portion confined by opposite longer walls and opposite shorter walls that interconnect the longer walls and that are shorter than the longer walls. At least one of the longer walls is formed with a set of first strap holes therethrough. The carrying strap has opposite sections that extend respectively through the first strap holes and that are formed with a respective retaining end for connecting the carrying strap to the bag body. The backing plate is disposed to lie against one of the longer walls of the mouth portion, and is formed with a set of second strap holes that permit extension of the opposite sections of the carrying strap therethrough. The sound generating module has a frame unit mounted on the backing plate, a data storage unit mounted on the frame unit for storing audio information, and an audio playback unit mounted on the frame unit and coupled to the data storage unit. The audio playback unit is operable so as to audibly reproduce the audio information in the data storage unit.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
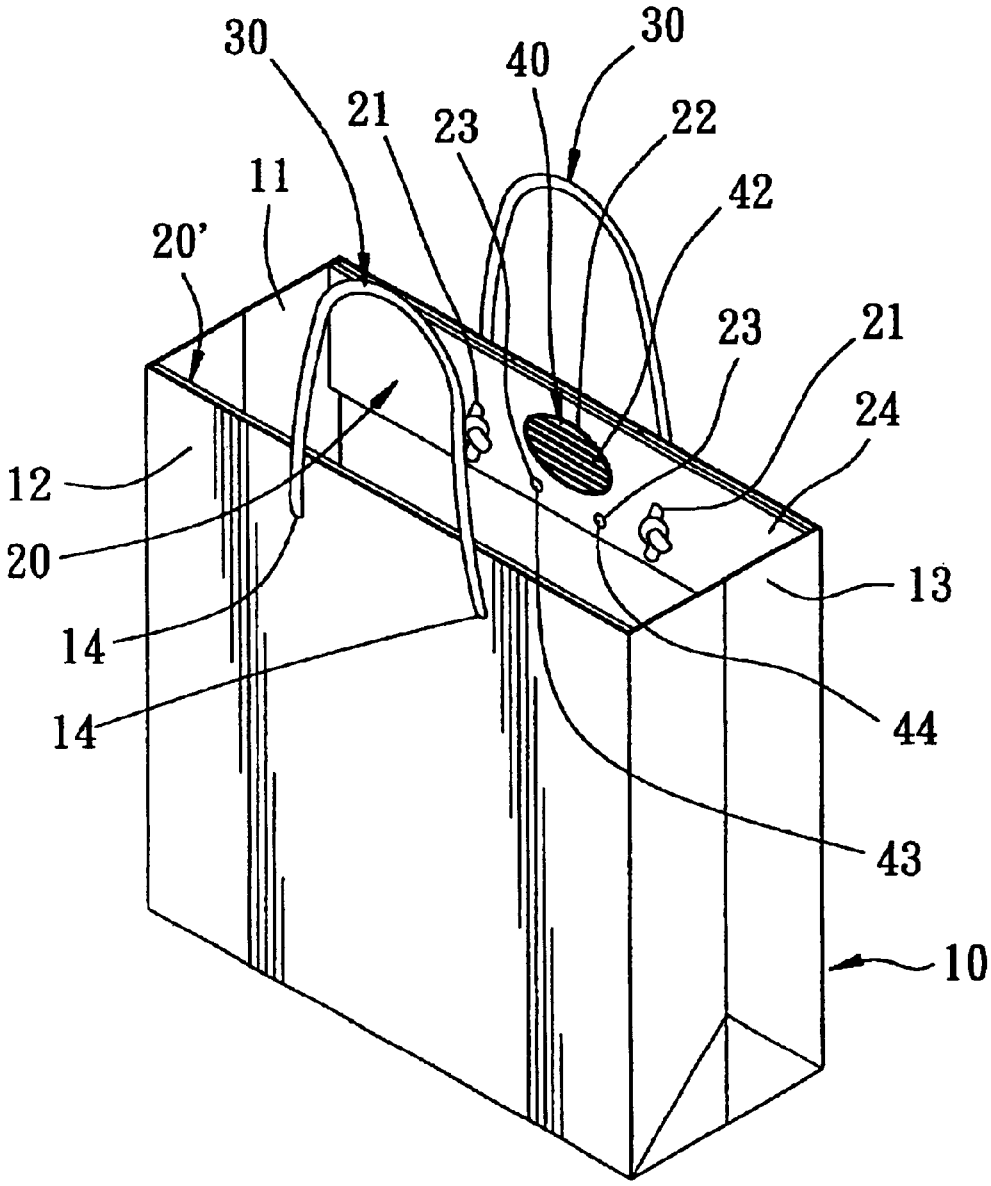
FIG. 1 is a perspective view of the first preferred embodiment of a bag according to the invention.
Figure 2:
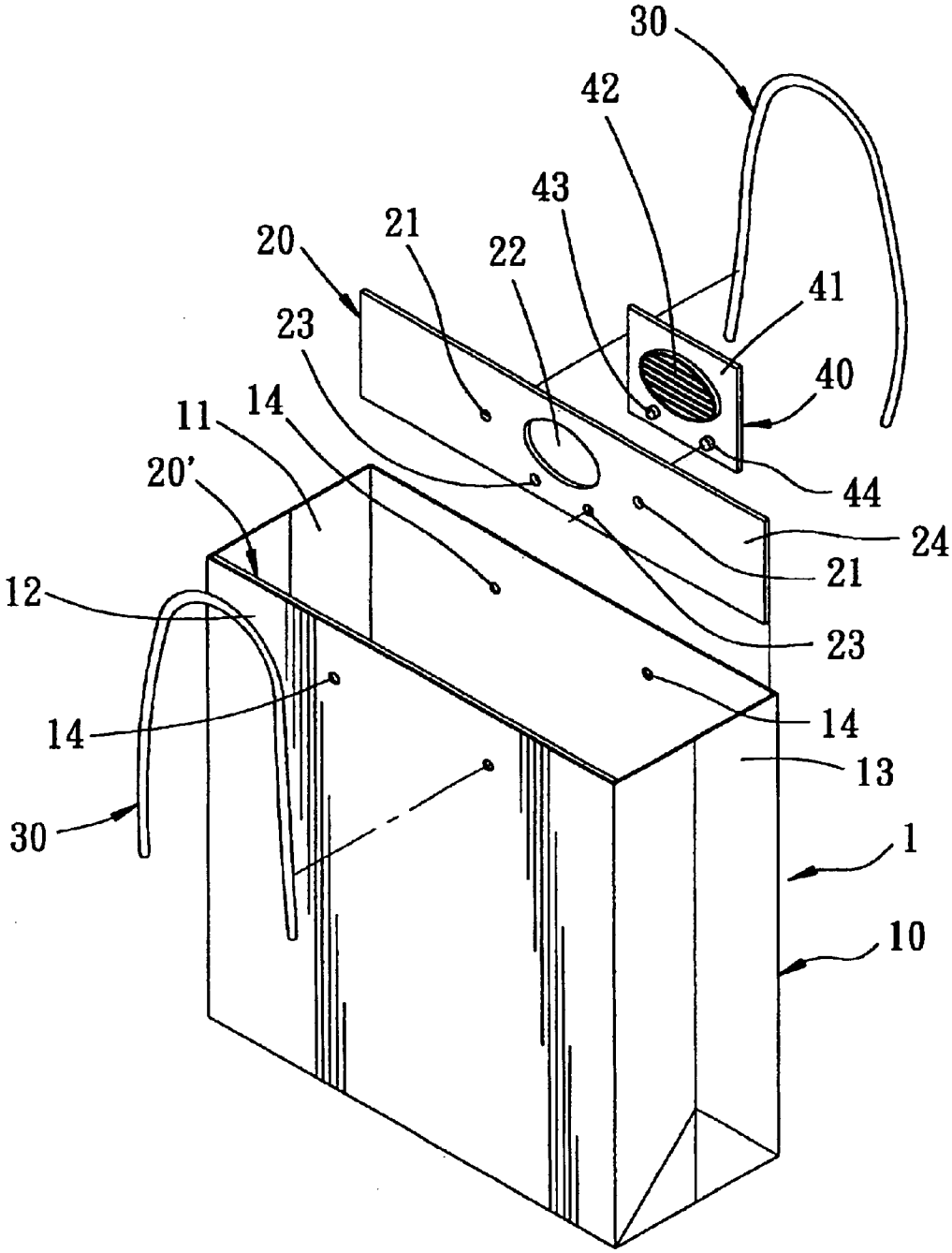
FIG. 2 is an exploded perspective view of the first preferred embodiment.

Referring to FIGS. 1 and 2, the first preferred embodiment of a bag 1 according to the present invention is shown to include an upright bag body 10, a carrying strap 30, a first backing plate 20, and a sound generating module 40.

The bag body 10 has a rectangular mouth portion 11 confined by opposite longer walls 12 and opposite shorter walls 13 that interconnect the longer walls 12 and that are shorter than the longer walls 12. At least one of the longer walls 12 is formed with a set of first strap holes 14 therethrough. In this embodiment, both of the longer walls 12 are formed with a respective set of first strap holes 14 therethrough.

The carrying strap 30 has opposite sections that extend respectively through the first strap holes 14 in one of the longer walls 12 and that are formed with a respective retaining end for connecting the carrying strap 30 to the bag body 10. In this embodiment, the bag 1 includes two carrying straps 30 to facilitate carrying.

The first backing plate 20 is disposed to lie against one of the longer walls 12 of the mouth portion 11, and is formed with a first set of second strap holes 21 that permit extension of the opposite sections of one of the carrying straps 30 therethrough. In this embodiment, the bag 1 further includes a second backing plate 20' disposed to lie against the other one of the longer walls 12 and formed with a set of second strap holes (not visible).

Figure 3:
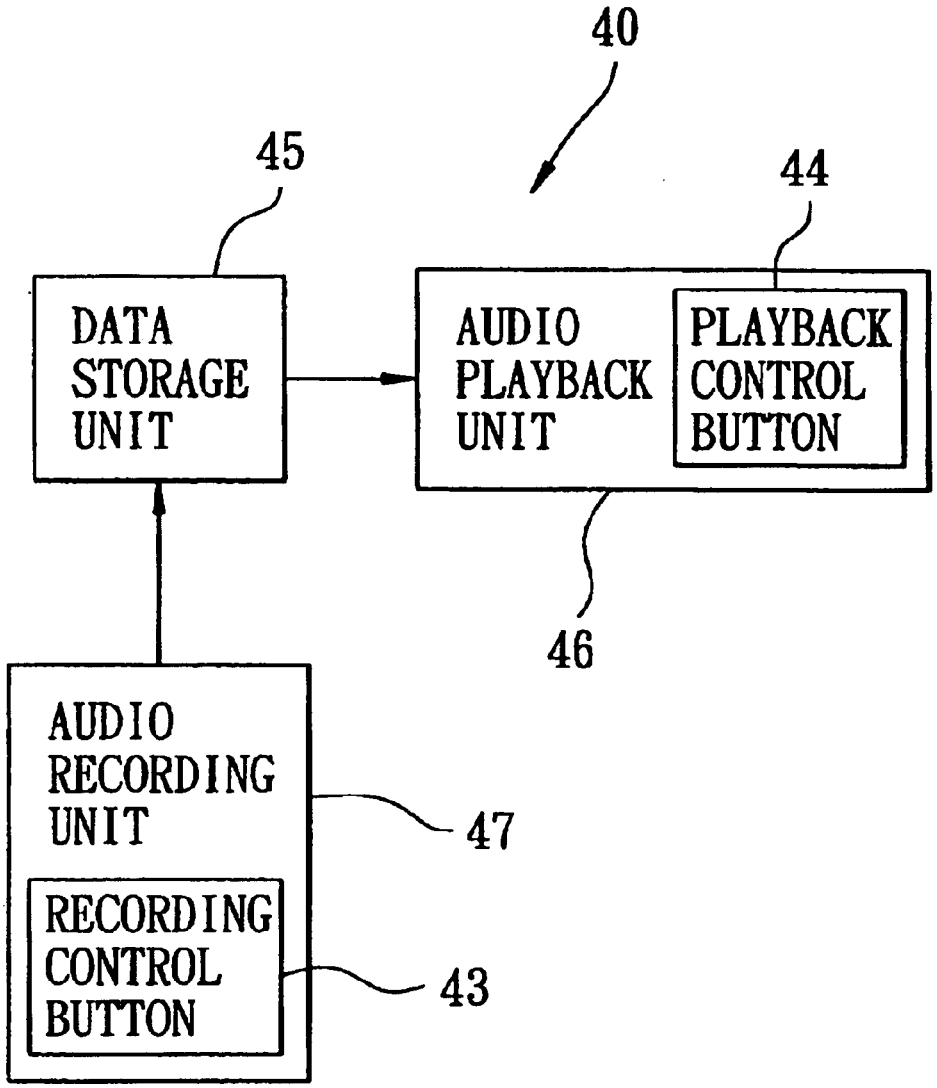
FIG. 3 is a block diagram illustrating a sound generating module of the first preferred embodiment.

With further reference to FIG. 3, the sound generating module 40 has a frame unit 41 mounted on the first backing plate 20, a data storage unit 45 mounted on the frame unit 41 for storing audio information, and an audio playback unit 46 mounted on the frame unit 41 and coupled to the data storage unit 45. The audio playback unit 46 has a playback control button 44 disposed on the frame unit 41 and operable so as to enable the audio playback unit 46 to audibly reproduce the audio information in the data storage unit 45. In this embodiment, the sound generating module 40 further has an audio recording unit 47 mounted on the frame unit 41 and coupled to the data storage unit 45 in a conventional maimer. The audio recording unit 47 has a recording control button 43 disposed on the frame unit 41 and operable so as to enable the audio recording unit 47 to record the audio information in the data storage unit 45 in a conventional manner. The frame unit 41 of the sound generating module 40 is disposed between the first backing plate 20 and the respective one of the longer walls 12 of the mouth portion 11, and further has a sound port 42. The first backing plate 20 is further formed with an opening 22 that is registered with the sound port 42, a first button hole 23 that permits extension of the playback control button 44 therethrough, and a second button hole 23 that permits extension of the recording control button 43 therethrough, so that the sound port 42, and the playback and recording control buttons 44, 43 are exposed from a surface 24 of the first backing plate 20 facing the second backing plate 20'.

During assembly, the first backing plate 20 with the sound generating module 40 mounted thereon is disposed to lie inboard to one of the longer walls 12 such that the sound generating module 40 is located between the first backing plate 20 and the respective one of the longer walls 12 and such that the first strap holes 14 are aligned with the second strap holes 21. Then, the opposite sections of one of the carrying straps 30 are extended in sequence through the first strap holes 14 and the second strap holes 21, respectively, and are formed with the retaining ends that are disposed on the surface 24 of the first backing plate 20, thereby securing the first backing plate 20 with the sound generating module 40 to the bag body 10. The second backing plate 20' is connected to bag body 10 in a similar manner. In use, the playback control button 44 can be pressed to playback the audio information, such as a voice message or a piece of music, in the data storage unit 45, and the recording control button 43 can be pressed to record the audio information in the data storage unit 45.

Figure 4:
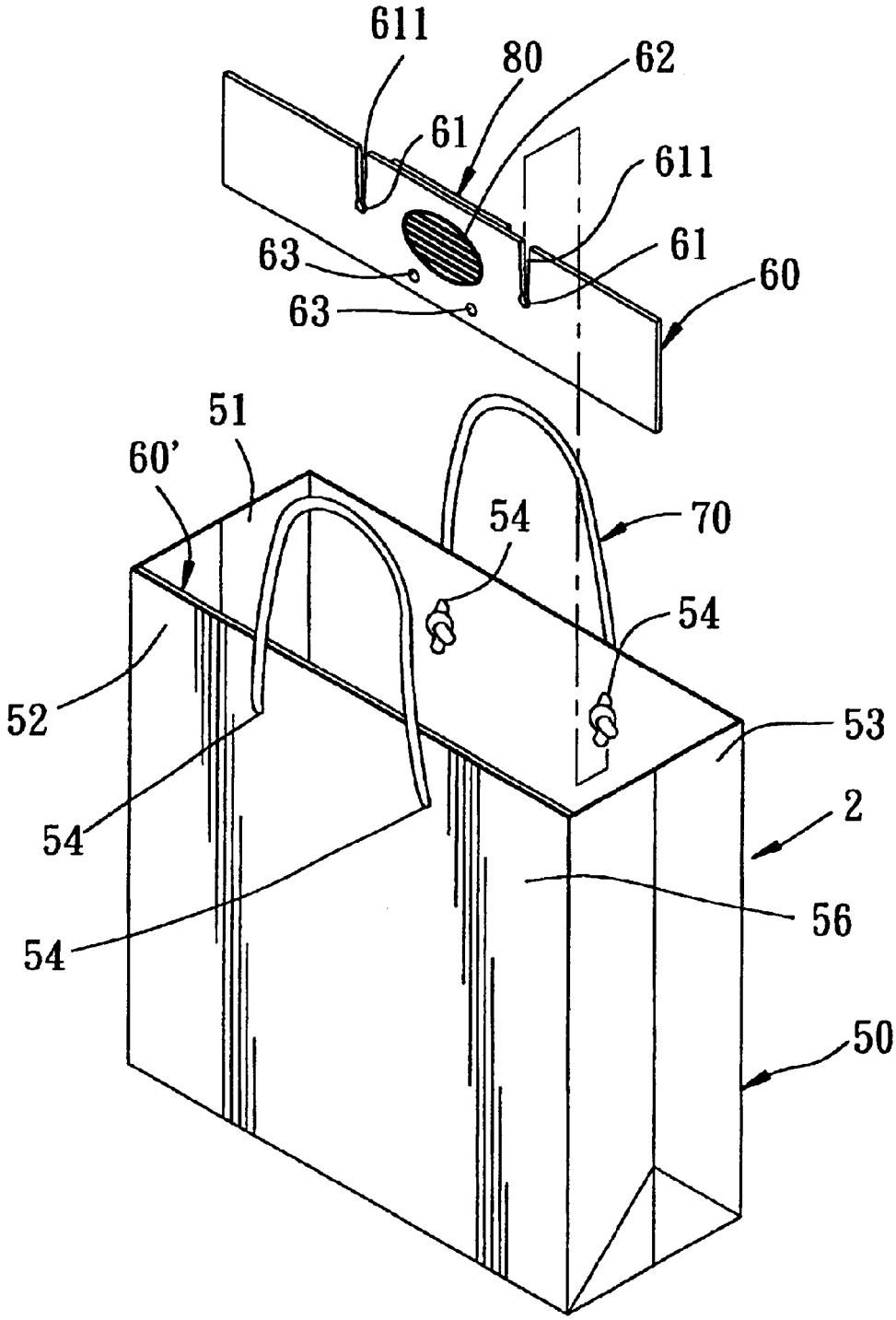
FIG. 4 is an exploded perspective view of the second preferred embodiment of a bag according to the present invention.
Figure 5:
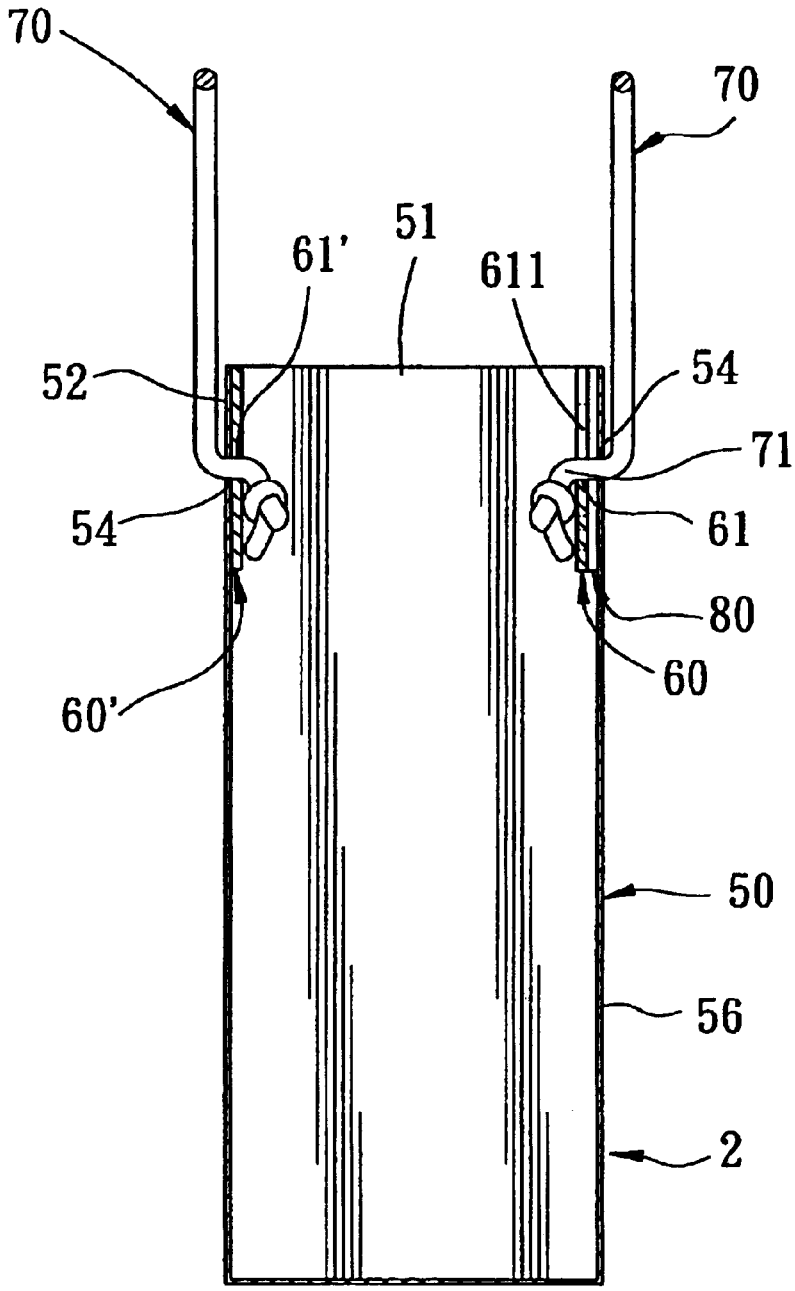
FIG. 5 is a sectional view of the second preferred embodiment.

FIGS. 4 and 5 show the second preferred embodiment of a bag 2 according to the present invention. The bag 2 includes a bag body 50, first and second backing plates 60, 60', two carrying straps 70, and a sound generating module 80. The bag body 50 has a mouth portion 51 confined by two opposite longer walls 52 formed with a respective set of first strap holes 54, and two opposite shorter walls 53. The first and second backing plates 60, 60' are formed with first and second sets of second strap holes 61, 61'. In this embodiment, the first backing plate 60 is further formed with a set of strap slits 611 that extend respectively from a top edge of the first backing plate 60 to the second strap holes 61. Each of the strap slits 611 has a width that narrows gradually from the top edge to the respective one of the second strap holes 61 in a substantially V-shaped configuration. The sound generating module 80 is mounted on the first backing plate 60, with a sound port aligning with and exposing from an opening 62 in the first backing plate 60 between the second strap holes 61. Two button holes 63 are also formed in the first backing plate 60 beneath the opening 62 for extension of playback and recording control buttons.

During assembly, opposite sections of each of the carrying straps 70 are respectively extended through the first strap holes 54 via an outer surface 56 of the respective one of the longer walls 50, and are formed with retaining ends that are disposed inboard to the respective one of the longer walls 50. Then, the strap slits 611 of the first backing plate 60 are aligned with the retaining ends of a respective one of the carrying straps 70, and the opposite sections of the respective carrying strap 70 are subsequently slid along the strap slits 611 for retention in the second strap holes 61. As such, the first backing plate 60 with the sound generating module 80 mounted thereon can be detachably secured to one of the carrying straps 70 inboard to one of the longer walls 52 of the bag body 50. The second backing plate 60' is disposed to lie against and inboard to the other one of the longer walls 52 and is connected to the bag body 50 by extending the opposite sections of the other one of the carrying straps 70 in sequence through the first strap holes 54 in the other one of the longer walls 52 and the second set of second strap holes 61', with the opposite sections subsequently formed with retaining ends.

Figure 6:
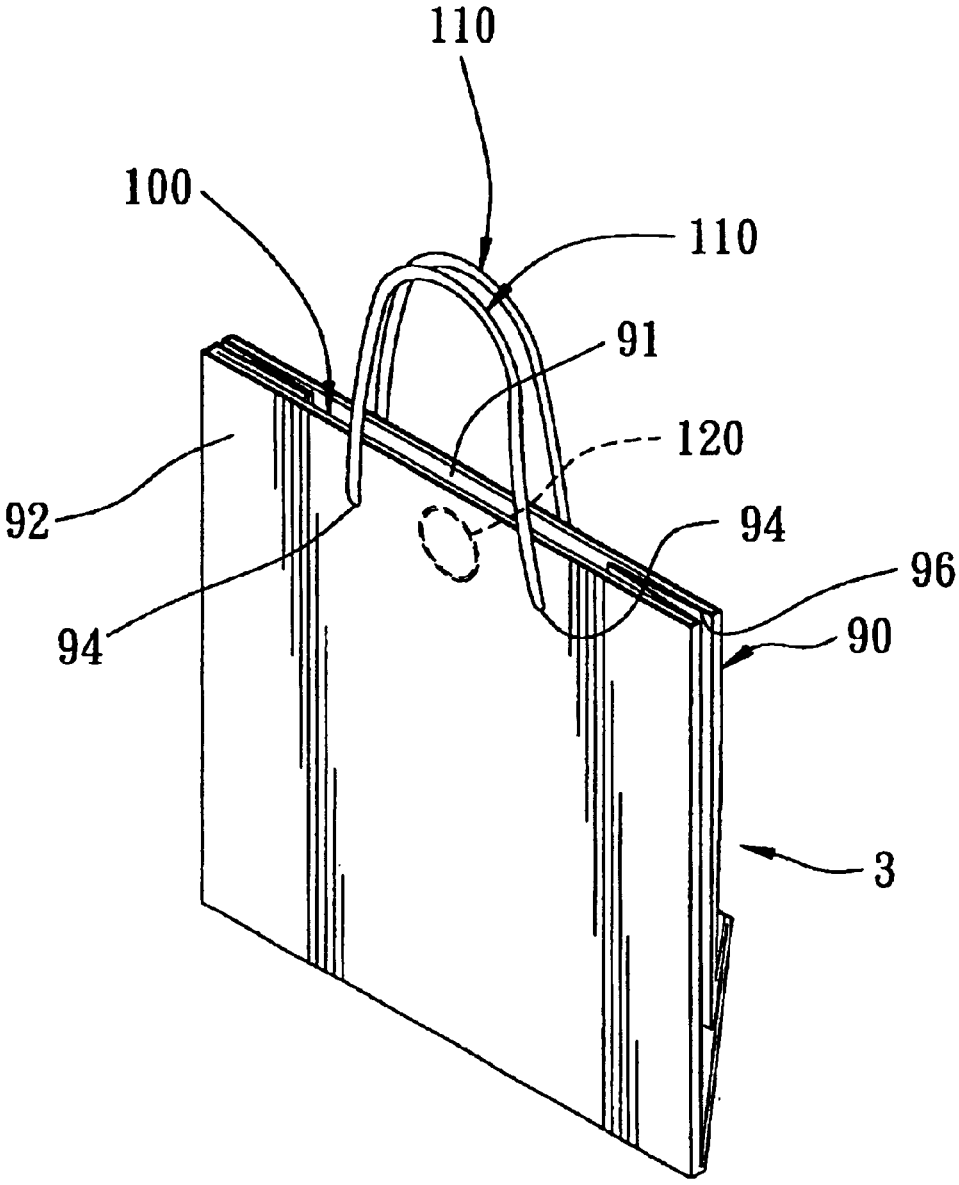
FIG. 6 is a perspective view of the third preferred embodiment of a bag according to the present invention when folded.
Figure 7:
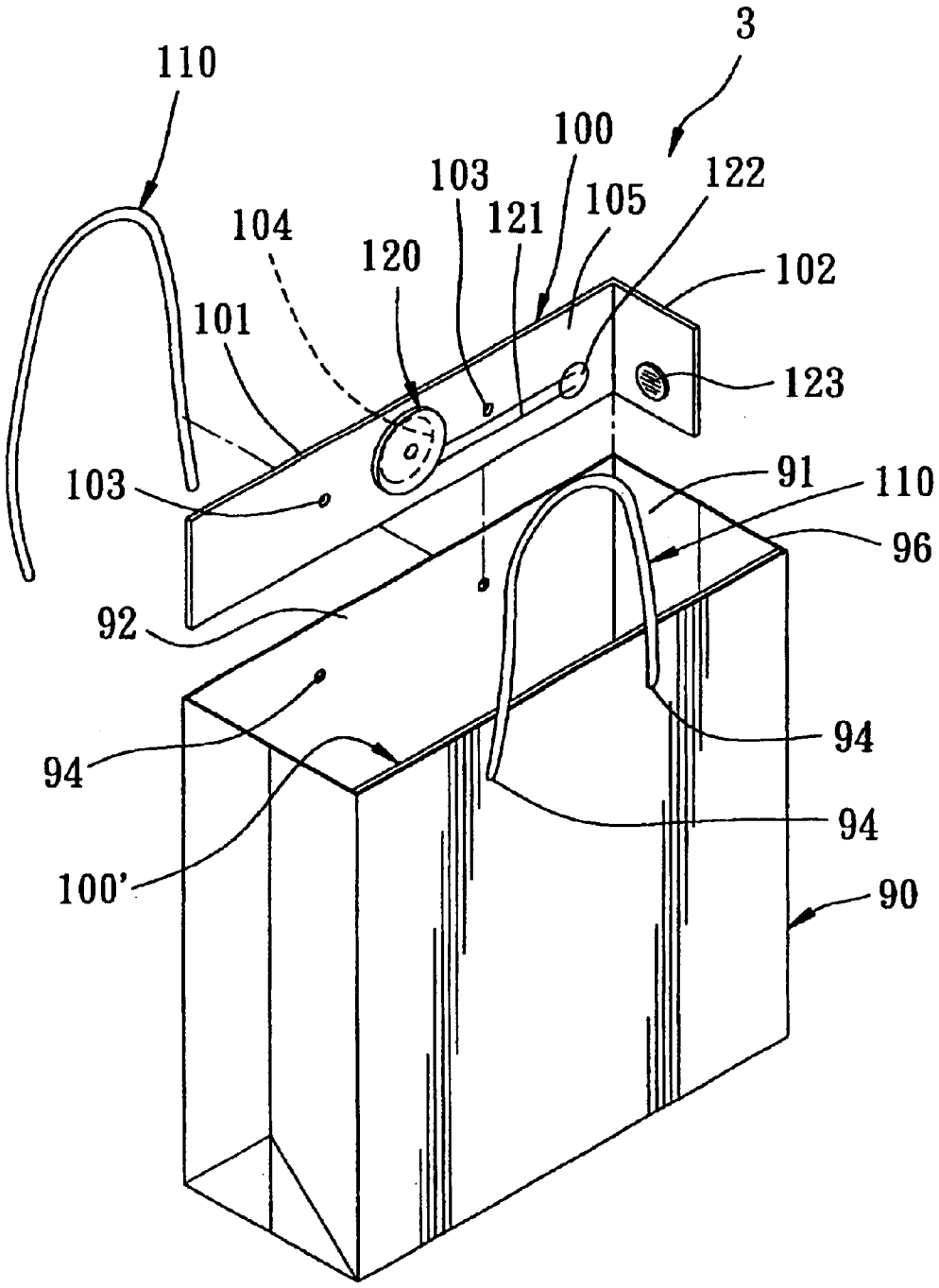
FIG. 7 is an exploded perspective view of the third preferred embodiment.
Figure 8:
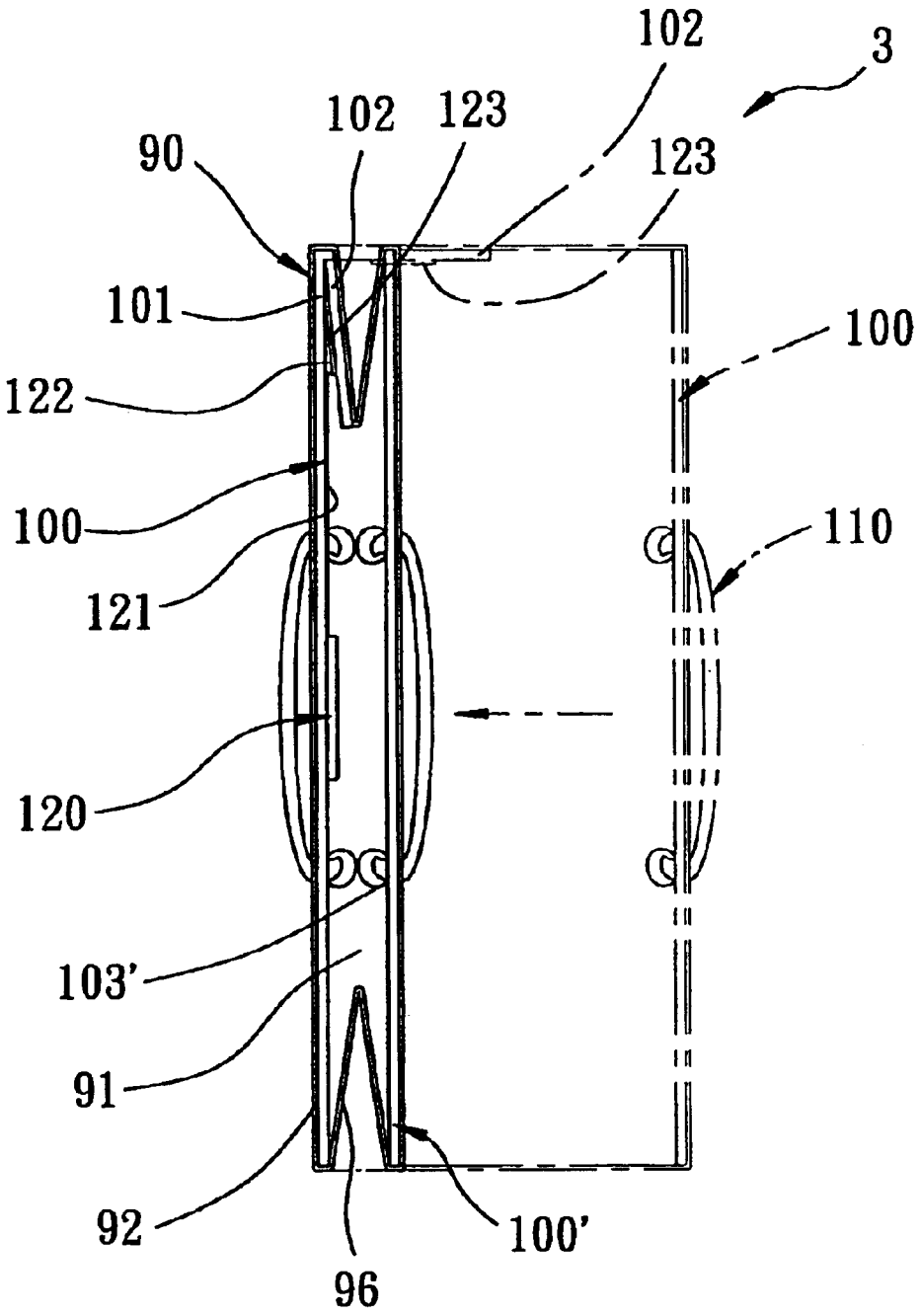
FIG. 8 is a schematic top view of the third preferred embodiment, illustrating folding and unfolding of the bag.
Figure 9:
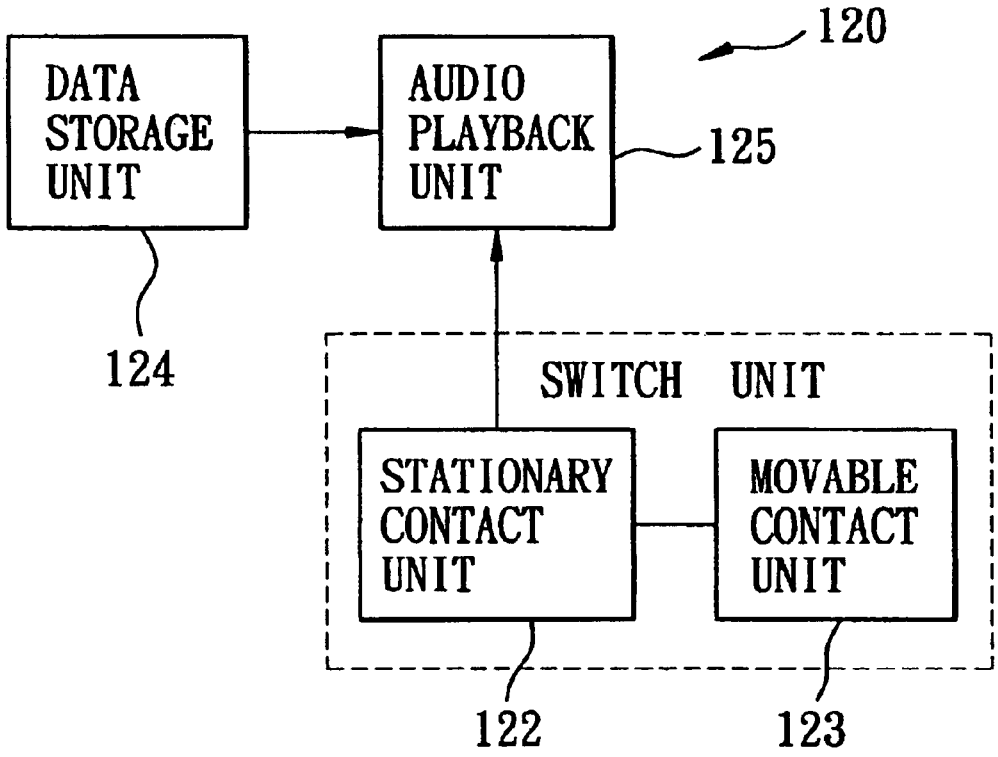
FIG. 9 is a block diagram illustrating a sound generating module according to the third preferred embodiment.

FIGS. 6 to 8 illustrate the third preferred embodiment of a bag 3 according to the present invention. The bag 3 includes a bag body 90, first and second backing plates 100, 100', two carrying straps 110, and a sound generating module 120. The bag body 90 has a mouth portion 91 confined by two opposite longer walls 92 and two opposite shorter walls 96. Each of the shorter walls 96 has two opposite lateral edges connected foldably and respectively to the longer walls 92, and is foldable along an upright folding line to form two shorter wall sections. Each of the longer walls 92 is formed with a respective set of first strap holes 94. In this embodiment, the first backing plate 100 has a longer plate section 101 that is disposed to lie against and inboard to one of the longer walls 92 and a shorter plate section 102 that extends from the longer plate section 101 to an adjacent one of the shorter wall sections and that is foldable toward the longer plate section 101 when the shorter walls 96 are folded. The longer plate section 101 is formed with a set of second strap holes 103, and an opening 104 disposed between the second strap holes 103. The second backing plate 100' is formed with a set of second strap holes 103' and is disposed to lie against and inboard to the other one of the longer walls 92. In this embodiment, with further reference to FIG. 9, the sound generating module 120 has a frame unit disposed in the opening 104, and includes a data storage unit 124 for storing prerecorded music, an audio playback unit 125, and a switch unit. The switch unit includes stationary and movable contact units 122, 123 respectively disposed on the longer and shorter plate sections 101, 102. The stationary contact unit 122 is connected to the audio playback unit 125 via two conductive wires 121. The movable contact unit 123 is disposed to contact the stationary contact unit 122 when the shorter plate section 102 is folded toward the longer plate section 101 so as to deactivate the audio playback unit 125 when the mouth portion 91 of the bag body 90 is closed.

During assembly, the first backing plate 100 with the sound generating module 120 mounted thereon is disposed to lie against and inboard to one of the longer walls 92 such that the shorter plate section 102 extends (and is optionally adhered) to an adjacent one of the shorter wall sections and such that the frame unit of the sound generating module 120 faces the other one of the longer walls 92. The opposite sections of one of the carrying straps 110 are extended in sequence through the first and second strap holes 94, 103, and are formed with retaining ends that are disposed on a surface 105 of the first backing plate 100 facing the other one of the longer walls 92, thereby securing the sound generating module 120 to the bag body 90. The second backing plate 100' is then disposed to lie against and inboard to the other one of the longer walls 92 and is attached to the bag body 90 by extending the opposite sections of the other one of the carrying straps 110 through the first strap holes 94 in the other one of the longer walls 92 and the second strap holes 103', with the opposite sections formed with retaining ends.

Referring back to FIG. 8, when the bag 3 is unfolded, the movable contact unit 123 is separated from the stationary contact unit 122, thereby activating the audio playback unit 125 to audibly reproduce the prerecorded music in the data storage unit 124 until the shorter walls 96 are folded once again to bring the movable contact unit 123 into contact with the stationary contact unit 122 to thereby deactivate the audio playback unit 125.

Due to the provision of the sound generating module, when the bag according to the present invention is used as a gift bag, the sender can send a voice message or a song with the gift bag to create a desired atmosphere that suits the occasion when the bag is opened. Moreover, the backing plate on which the sound generating module is mounted can be detachably attached to the bag in a convenient manner.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A bag comprising:

an upright bag body having a rectangular mouth portion confined by opposite longer walls and opposite shorter walls that interconnect said longer walls and that are shorter than said longer walls, at least one of said longer walls being formed with a set of first strap holes therethrough;

a carrying strap having opposite sections that extend respectively through said first strap holes and that are formed with a respective retaining end for connecting said carrying strap to said bag body;

a backing plate disposed to lie against one of said longer walls of said mouth portion, and formed with a set of second strap holes that permit extension of said opposite sections of said carrying strap therethrough; and a sound generating module comprising:

a frame unit mounted on said backing plate;

a data storage unit mounted on said frame unit for storing audio information;

an audio playback unit mounted on said frame unit and coupled to said data storage unit, said audio playback unit being operable so as to audibly reproduce the audio information in said data storage unit; and an audio recording unit mounted on said frame unit and coupled to said data storage unit, said audio recording unit being operable so as to record the audio information in said data storage unit, wherein said frame unit has a sound port, and said audio playback unit has a playback control button disposed on said frame unit and operable so as to enable said audio playback unit to audibly reproduce the audio information in said data storage unit, wherein said audio recording unit has a recording control button disposed on said frame unit and is operable so as to enable said audio recording unit to record the audio information in said data storage unit, wherein said frame unit is disposed between said backing plate and said one of said longer walls of said mouth portion, and said backing plate is formed with an opening that is registered with said sound port, wherein a first button hole permits extension of said playback control button therethrough, and a second button hole permits extension of said recording control button therethrough.

2. The bag of claim 1, wherein said backing plate has a top edge and is further formed with a set of strap slits that extend respectively from said top edge to said second strap holes.

3. The bag of claim 2, wherein each of said strap slits has a width that narrows gradually from said top edge of said backing plate to the respective one of said second strap holes.

4. The bag of claim 1, wherein said backing plate has a top edge and is further formed with a set of strap slits that extend respectively from said top edge to said second strap holes.

5. The bag of claim 4, wherein each of said strap slits has a width that narrows gradually from said top edge of said backing plate to the respective one of said second strap holes.

6. The bag of claim 1, wherein each of said shorter walls of said bag body has two opposite lateral edges connected foldably and respectively to said longer walls, each of said shorter walls being further foldable along an upright folding line to form two shorter wall sections.

7. The bag of claim 6, wherein said sound generating module further includes a switch unit for activating said audio playback unit so as to audibly reproduce the audio information in said data storage unit when said shorter walls are unfolded, and for deactivating said audio playback unit when said shorter walls are folded.

8. The bag of claim 7, wherein said backing plate has a longer plate section disposed to lie against said one of said longer walls, and a shorter plate section disposed to extend from said longer plate section to an adjacent one of said shorter wall sections and foldable toward said longer plate section when said shorter walls are folded, said frame unit of said sound generating module being mounted on said longer plate section, said switch unit having a stationary contact unit disposed on said longer plate section and connected electrically to said audio playback unit, and a movable contact unit disposed on said shorter plate section and disposed to contact said stationary contact unit for deactivating said audio playback unit when said shorter walls are folded, said movable contact unit separating from said stationary contact unit for activating said audio playback unit when said shorter rails are unfolded.

9. A bag comprising:

an upright bag body having a rectangular mouth portion confined by opposite longer walls and opposite shorter walls that interconnect said longer walls and that are shorter than said longer walls, at least one of said longer walls being formed with a set of first strap holes therethrough, wherein each of said shorter walls of said bag body has two opposite lateral edges connected foldably and respectively to said longer walls, and each of said shorter walls is further foldable along an upright folding line to form two shorter wall sections;

a carrying strap having opposite sections that extend respectively through said first strap holes and that are formed with a respective retaining end for connecting said carrying strap to said bag body;

a backing plate disposed to lie against one of said longer walls of said mouth portion, and formed with a set of second strap holes that permit extension of said opposite sections of said carrying strap therethrough; and a sound generating module comprising:

a frame unit mounted on said backing plate;

a data storage unit mounted on said frame unit for storing audio information;

an audio playback unit mounted on said frame unit and coupled to said data storage unit, said audio playback unit being operable so as to audibly reproduce the audio information in said data storage unit; and a switch unit for activating said audio playback unit so as to audibly reproduce the audio information in said data storage unit when said shorter walls are unfolded, and for deactivating said audio playback unit when said shorter walls are folded, wherein said backing plate has a longer plate section disposed to lie against said one of said longer walls, and a shorter plate section disposed to extend from said longer plate section to an adjacent one of said shorter wall sections and foldable toward said longer plate section when said shorter walls are folded, wherein said frame unit is mounted on said longer plate section, and said switch unit comprises:

a stationary contact unit disposed on said longer plate section and connected electrically to said audio playback unit; and a movable contact unit disposed on said shorter plate section and disposed to contact said stationary contact unit for deactivating said audio playback unit when said shorter walls are folded, said movable contact unit separating from said stationary contact unit for activating said audio playback unit when said shorter walls are unfolded.

* * * * *